US007584540B2

(12) United States Patent
Latham

(10) Patent No.: US 7,584,540 B2
(45) Date of Patent: Sep. 8, 2009

(54) METHOD OF CONSTRUCTING FORMWORK AND AN ELEMENT FOR CASTING CONCRETE COMPONENTS

(75) Inventor: Benedict Latham, Upper Hutt (NZ)

(73) Assignee: Ronald Lindsay Dunlop, Auckland (NZ)

( * ) Notice: Subject to any disclaimer, the term of this patent is extended or adjusted under 35 U.S.C. 154(b) by 1306 days.

(21) Appl. No.: 10/168,793

(22) PCT Filed: Dec. 22, 2000

(86) PCT No.: PCT/NZ00/00262

§ 371 (c)(1),
(2), (4) Date: Sep. 24, 2002

(87) PCT Pub. No.: WO01/46538

PCT Pub. Date: Jun. 28, 2001

(65) Prior Publication Data

US 2004/0084603 A1 May 6, 2004

(30) Foreign Application Priority Data

Dec. 22, 1999 (NZ) ..... 338058
Jul. 5, 2000 (NZ) ..... 505579

(51) Int. Cl.
*B21K 23/00* (2006.01)

(52) U.S. Cl. ..... 29/897.312

(58) Field of Classification Search ..... 29/525.01, 29/897.312, 897.3, 897.34; 249/188, 18
See application file for complete search history.

(56) References Cited

U.S. PATENT DOCUMENTS 4,183,497 A 1/1980 Tamez ..... 249/205
5,766,645 A 6/1998 Kaminski ..... 425/63

FOREIGN PATENT DOCUMENTS

AU 74448/94 12/1994
WO WO98/49415 11/1998

*Primary Examiner*—John C Hong
(74) *Attorney, Agent, or Firm*—Jacobson Holman PLLC

(57) ABSTRACT

A concrete component firstly includes arranging on a casting substrate, a plurality of elongate casting elements to define the outline of the component to be cast. A plurality of wall portions are then selected having a width commensurate with the width of the sides of the component to be cast. The casting elements each have locating portions to receive at least an edge of one or more of the wall portions. The plurality of wall portions are located with the locating portions of the casting elements to define a continuous wall along the outline of the component to be cast and to thereby delimit the sides of the component to be cast. The casting elements are then anchored to the casting substrate. The concrete casting elements may include a chamfering portion adapted to chamfer an edge of the component.

29 Claims, 10 Drawing Sheets

METHOD OF CONSTRUCTING FORMWORK AND AN ELEMENT FOR CASTING CONCRETE COMPONENTS

This is a nationalization of PCT/NZ00/00262, filed Dec. 22, 2000 and published in English.

FIELD OF THE INVENTION

The invention relates to an apparatus and method for precasting concrete and in particular to a modular and easily adjustable boxing system to assist in preparing precast concrete components for use in the construction industry. While the invention is particularly described in connection with concrete construction, it may have application to other construction materials and even to other settable materials.

BACKGROUND TO THE INVENTION

The use of precast concrete components such as slabs, columns etc in the construction industry is well known. This avoids the need for casting concrete components in situ and renders unnecessary the extra formwork and labour needed to pour, form and hold wet concrete in place until it sets. The components can instead be precast offsite, or at least away from the main construction area, and when needed the components are transported by truck and/or lifted into position by crane and incorporated into the existing structure.

Precasting is typically performed in horizontal casting beds with the extremities of the required components defined by formwork typically in the form of L-shaped extrusions. As will be appreciated, the maximum height of the component being formed will be determined by the height of the L-shaped extrusion. Thus, it may be necessary to have lengths of formwork of varying heights to suit a range of casting jobs. This is particularly necessary if components are cast progressively on top of each other.

Concrete can be brittle and easily chipped or broken where it is thinnest in a component. Typically this occurs on the comers and edges of the component during removal from the mould, transportation and placement. Such damage, which may lead to weakness and which looks unattractive where the components are to remain exposed in a structure, can be avoided by providing the component with chamfered edges. An existing method used to create the chamfer involves placing a plastic triangular sectioned component at the bottom comer of the mould created by the L-shaped sections. However, it will be appreciated that this only allows for the edge at the bottom of the mould to be chamfered.

It is therefore an object of the invention to provide a system to facilitate the production of precast concrete elements for use in the construction industry; and/or to overcome or address at least one of the disadvantages of the prior art; and/or at the least to provide the public with a useful choice.

SUMMARY OF THE INVENTION

According to one aspect of the invention there is provided a method of assembling formwork for casting a concrete component. the method including:

arranging on a casting substrate, a plurality of elongate casting elements to define the outline of the component to be cast, providing wall portions to associate with the casting elements to define wall surfaces to delimit the sides of the component to be cast, the casting elements each incorporating a chamfer to truncate the apex of the mould space defined by the casting substrate and the wall surface; and anchoring the casting elements to the casting substrate.

Preferably the casting substrate is a horizontal casting bed and the wall portions define the upright sides of the component to be cast. However the invention is not limited to this and may be adapted to be used with other forms of casting substrate such as a form to be arranged in a vertical orientation as opposed to a horizontal orientation.

Preferably the casting element supports one or more wall portions in the form of an elongate board/planar rectangular sheet. In a highly preferred form, the casting element defines a channel, preferably a substantially U-shaped channel to receive at least an edge of the wall portion and the method includes inserting the wall portion into the channel.

Preferably the chamfer is defined by a projection that is substantially triangular in cross-section. The projection may be three-sided or only two sides of the triangular cross-section may be defined, those being the base and the chamfer.

In a preferred embodiment, the present method includes the step of locating on the upper edge of the wall portions, additional elongate casting members wherein the additional elongate casting members also incorporate a chamfer to truncate the apex of the mould space defined by the casting substrate and the upper surface of the component to be cast. Preferably, the additional elongate casting members are identical to the elongate casting elements, with the additional members being inverted.

Additionally, it is preferable for the element to have a longitudinal plane of symmetry thereby defining two chamfers, the element including mounting portion disposed substantially along the plane of symmetry. In a highly preferred form the element has a plane of symmetry thereby defining two channels and two projections, the element including a central H section bisected by the plane of symmetry, the central H section having two sides and a bridge, with the sides of the H section defining respective inner walls of said two channels and with flanges extending inwards from the tops of the sides of the H section. The projections define respective outer walls of the two channels.

According to another aspect of the invention, the wall portion may be integral with the casting elements. Accordingly, there is provided a method of assembling formwork for casting a concrete component. the method including:

arranging on a casting substrate, a plurality of elongate casting elements to define the outline of the component to be cast, the casting elements having wall portions to define wall surfaces to delimit the upright sides of the component to be cast, the casting elements each incorporating a chamfer to truncate the apex of the mould space defined by the casting substrate and the wall surface; and anchoring the casting elements to the casting substrate.

Any of the preferred features of the first aspect of the invention may have application to the above aspect of the invention.

According to a third aspect of the invention there is provided a method of assembling formwork for casting a concrete component, the method including the following, not necessarily in the following order:

(A) arranging on a casting substrate, a plurality of elongate casting elements to define the outline of the component to be cast.

(B) selecting a plurality of wall portions having a width commensurate to the casting width of the sides of the component to be cast wherein the casting elements each have a locating portion to receive at least an edge of one or more of said wall portions;

(C) locating the plurality of wall portions with the locating portions of the element to define a continuous wall along the outline of the component to be cast and thereby delimit the sides of the component to be cast; and (D) anchoring the casting elements to the casting substrate.

The method need not be performed in the stated order. For example, the act of anchoring may be performed prior to the step of selecting and locating. Alternatively, the act of anchoring may be between the acts of selecting and locating.

Preferably the casting substrate is a horizontal casting bed and the wall portions define the height of the components to be cast. In an alternative form of the invention, the substrate may comprise forms such as plywood sheets to which the casting elements are anchored. The substrate may be arranged at any orientation for the concrete pour. In particular, the substrate may be oriented vertically to cast in-situ, components such as walls and columns. This may employ first and second of such casting elements anchored at a spacing on a first form with a second form being provided to which a third and fourth casting elements are anchored. A first of such wall portions extends between the first and third casting elements and a second of such wall portions extends between the second and fourth casting elements.

Preferably the locating portion is defined as a substantially U-shaped channel.

In a preferred embodiment of this aspect a further step is locating on the upper edge of the wall portion, additional elongate casting members wherein the additional elongate casting members have further locating portion to receive an upper edge of a wall portion. In a highly preferred embodiment, the additional elongate casting members are identical to the elongate casting elements, the additional members being inverted.

Preferably the casting elements incorporate a chamfering portion to truncate the apex of the mould space defined by the casting substrate and the wall surface. Also, the additional elongate casting members incorporate a chamfering portion to truncate the apex of the mould space defined by the casting substrate and the upper surface of the component to be cast. Preferably the chamfer is defined by a projection that is substantially triangular in cross-section. The projection may be three-sided or only two sides of the triangular cross-section may be defined, those being the base and a surface to define the chamfer.

Each casting element may not be in one piece and but in several pieces which may be interlocking or interconnecting. The chamfer may be created by a separate piece affixed to the casting substrate.

The element of the second aspect of the invention preferably has a longitudinal plane of symmetry thereby defining two locating portion and two chamfers, the element including mounting portion disposed substantially along the plane of symmetry. In a highly preferably form the element has a plane of symmetry thereby defining two channels and two projections, the element including a central H section bisected by the plane of symmetry, the central H section having two sides and a bridge, with the sides of the H section defining respective inner walls of said two channels and with two flanges extending inwards from the tops of the sides of the H section. The projections define respective outer walls of the two channels.

A preferable method of forming corners in the formwork of the first and second aspects of the invention is provided where a first of such casting elements may be abutted to a second of such casting elements by cutting the longitudinal end of the first element (and the wall portion located in it) to accept the projection forming the chamfer.

In the event that the components to be precast require rebating, the additional elongate elements can be replaced with rebating members defining the required rebate. Preferably the rebating members are wood or plywood shapes of the required dimensions. Additionally, inserts may be included in a component as required by mounting them onto the wall portion prior to casting.

In accordance with a preferred form of the invention, components may be cast one atop the other. This is achieved once the existing component is cast by arranging further casting elements in a layer atop the existing component.

According to a fourth aspect of the invention there is provided an element for use in a system for casting a concrete component, the element including a chamfering portion adapted to chamfer an edge of the component and a locating portion adapted to receive an upright member to define the side walls of the component.

Preferably the chamfering portion is substantially triangular in cross-section. The chamfering portion may be three-sided or only two sides of the triangular cross-section may be defined, those being the base and a surface to define the chamfer. Preferably the chamfer provided to the component by each aspect is planar or convex.

The chamfering portion may be in the form of a projection integral with the casting element. However the casting element may not be in one piece and but in several pieces which may be interlocking or interconnecting. The chamfer may be created by a separate piece which can be affixed to the casting substrate.

Preferably the locating portion is defined by a substantially U-shaped channel. In a most preferred from of the invention, the element is an integrally formed member (eg by extrusion) incorporating the projection and the U-shaped channel.

In a preferred form the element has a longitudinal plane of symmetry thereby defining two locating portion and two projections. the element including mounting portion disposed substantially along the plane of symmetry. In a highly preferred form the element has a plane of symmetry thereby defining two channels and two projections, the element including a central H section bisected by the plane of symmetry, the central H section having two sides and a bridge, with the sides of the H section defining respective inner walls of said channels and with flanges extending inwards from the tops of the sides of the H section. The projections define respective outer walls of the channels. The various parts of the casting element need not be of a constant thickness.

In respect of all of the above aspects of the invention. preferably the mounting portion is provided with a plurality of holes adapted to receive bolts or similar devices to secure an element to the casting substrate and/or to bolt two elements together. In a highly preferable form these holes are formed in the bridge of the central H-section.

In regards to the materials used in each aspect it is preferred that the element is extruded and ideally the element is extruded from aluminium, The sheets used may be made from wood or plywood or medium density fibreboard.

Reinforcing may be added before the concrete is introduced as described below.

This invention may also be said broadly to consist in the parts, elements and features referred to or indicated in the specification of the application, individually or collectively, and any or all combinations of any two or more of said parts, elements or features, and where specific integers are mentioned herein which have known equivalents in the art to which this invention relates, such known equivalents are deemed to be incorporated herein as if individually set forth.

The invention consists in the foregoing and also envisages constructions of which the following gives examples.

DETAILED DESCRIPTION OF THE INVENTION

Figure 1:
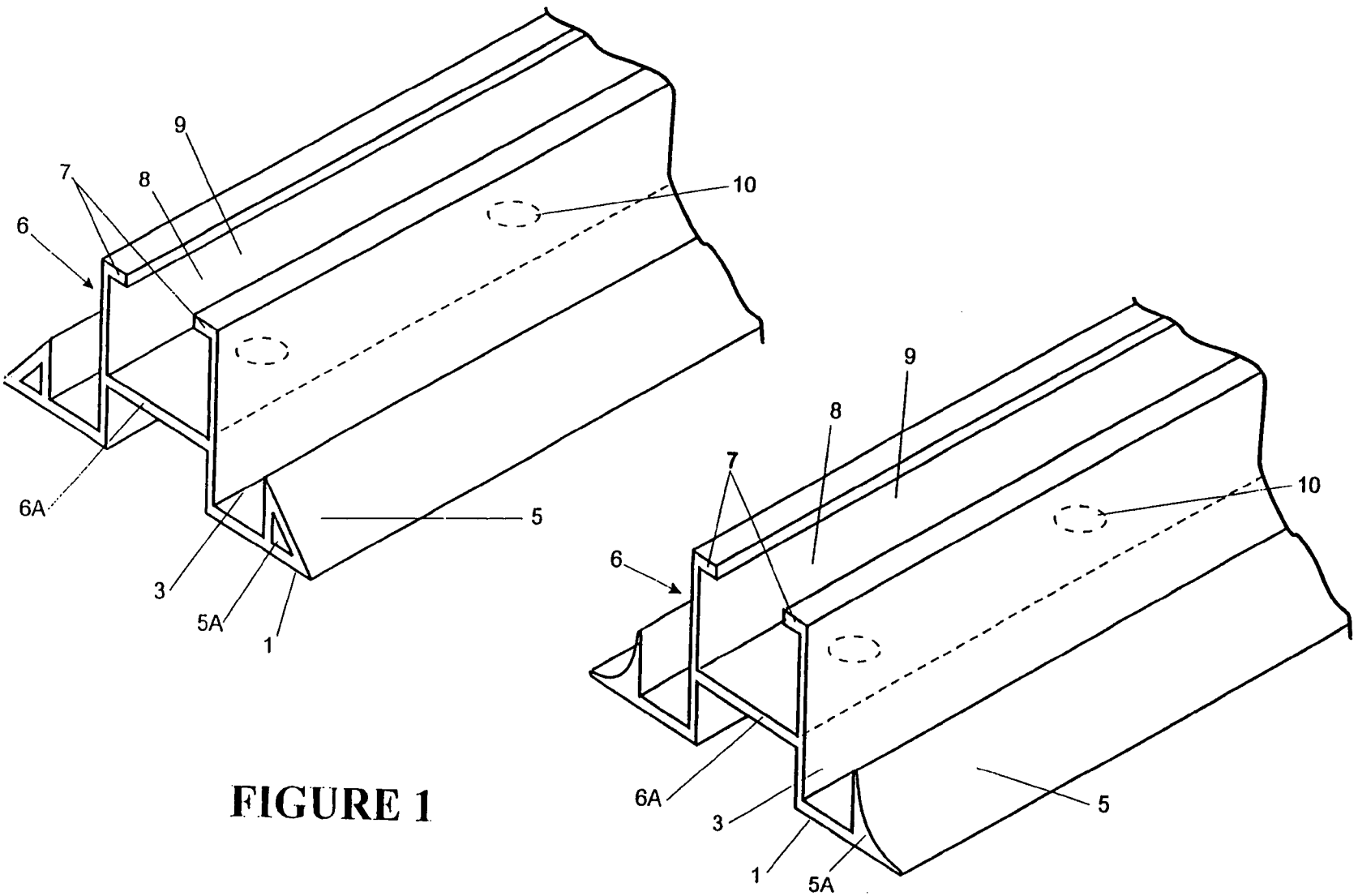
FIG. 1 shows perspective views of two embodiments of a casting element according to one preferred embodiment of the invention.

Referring to FIG. 1, the element of the invention is of elongate form with a constant cross-section. The element is designed to rest on its base 1 on a solid surface known in the art as a casting bed 2, as shown in FIG. 2.

Channels 3 are provided on both sides of the element to accept substantially rectangular planar sheets 4 that define the sides of the component to be precast. The transverse width (height) of a sheet depends on the size of the side of the component to be precast. The depth of the sheet is uniform and typically less than 18 mm so as to fit in the channel. The longitudinal length of the sheet is typically of a standard length shorter than the element.

Figure 2:
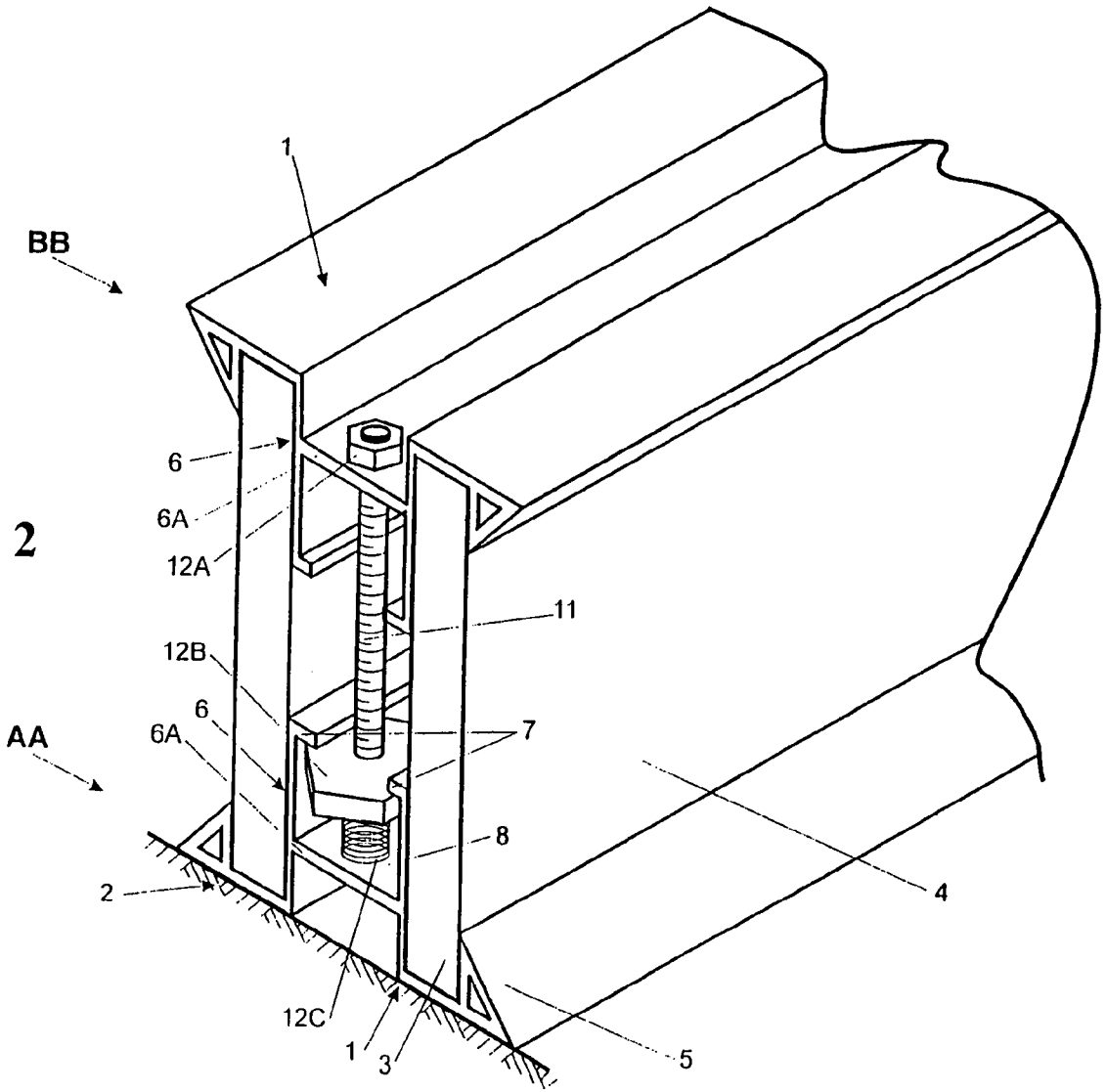
FIG. 2 is a perspective view of an assembled apparatus according to a preferred embodiment of the invention.

The shaping surface 5 of the element fills in the apex of the angle defined by the base and the outer side of a channel 3 so as to form a chamfered edge on the component, as shown in FIG. 2. Two preferred embodiments of the element with flat and concave shaping surfaces are depicted in FIG. 1. Preferably the projection 5A forming the shaping surface is substantially a right-angled triangle in cross-section as shown.

The raised central H-section 6 has two sides, a bridge 6A and inwardly directed flanges 7 that define a cavity 8 and a slot 9 that both run the length of the element. The sides of the H section define respective inner walls of the channels 3 and the projections 5A define respective outer walls of the channels. A plurality of holes 10 are formed in the bridge of the central H-section, spaced out alone the length of the element.

Two elements and two sheets are assembled into the apparatus shown in FIG. 2. This apparatus serves to form a vertical side of two components to be cast side-by-side. The number of elements and sheets required in use to cast a component will depend on the size and shape of the component. It can be seen that the apparatus comprises a first lower element AA resting on a casting bed with the required sheets inserted into the channels on the first element. A second element BB is then inverted and placed on top of the sheets so that the upper ends of the sheets fit into the channels of the second element.

Preferably the apparatus is held together using a bolt 11 that passes through the hole 10 and slot 9 in the upper element BB, and through the slot in the lower element to terminate in the cavity 8 of the lower element AA. Nuts 12A and 12B having internal threads corresponding to external threads on each longitudinal end of the bolt, engage the elements and, when tightened on the bolt. draw the elements together to bear upon the sheets, locking the apparatus together. As shown in FIG. 2 the nut 12A on the upper end of the bolt rests in the U-shaped channel on the underside of the element BB defined underneath the raised section 6. The nut 12B on the lower end of the bolt is positioned in the cavity 9 and held against the underside of the flanges 7 by an optional spring 12C. The nut 12B bears upon the underside of the flanges when it is threaded onto the bolt. Preferably neither the nut nor the bolt project above the base of the upper element BB to allow for screeding by methods known in the art. The bolts 11 may be equally spaced along the length of an element.

Figure 3:
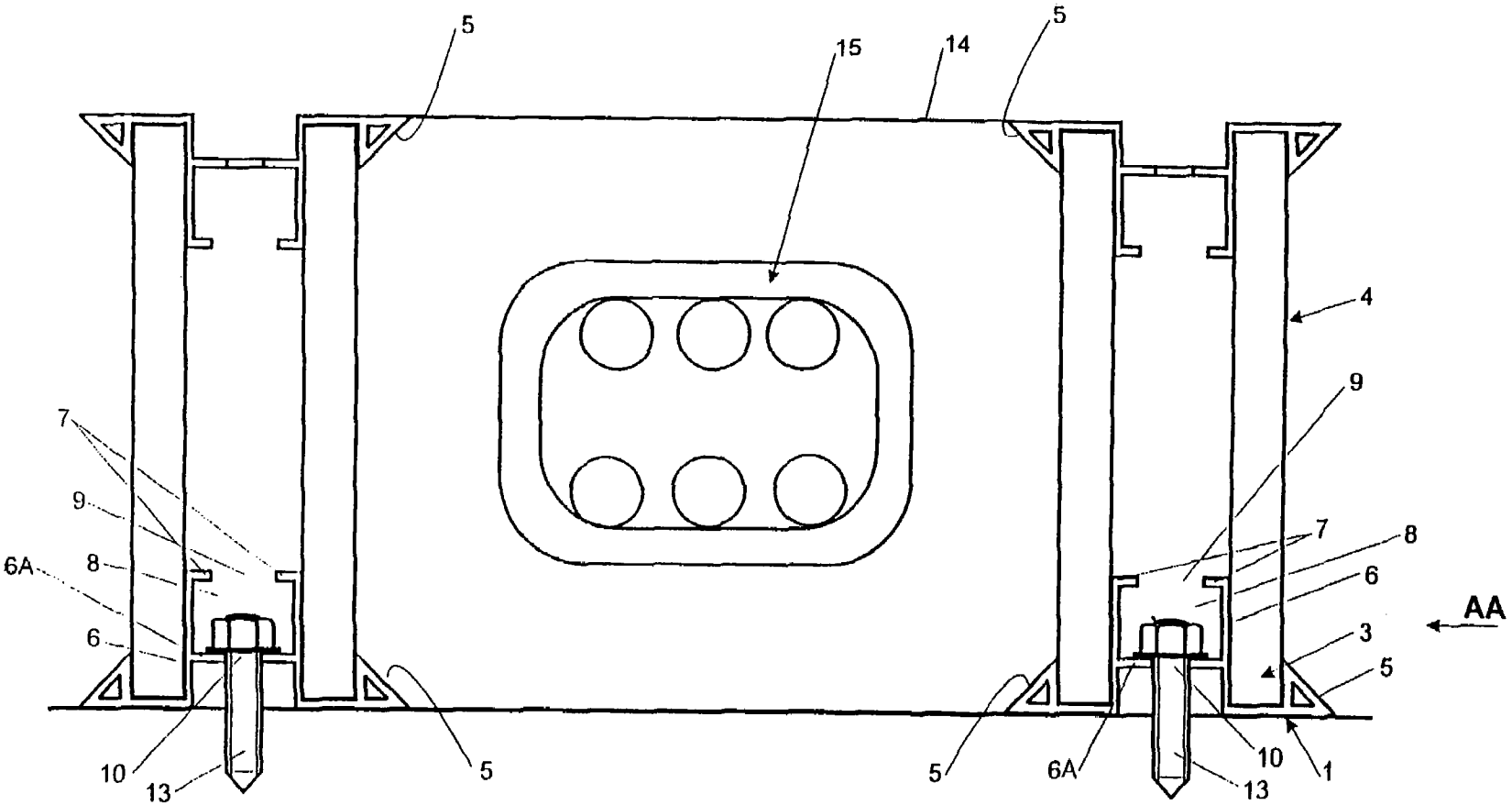
FIG. 3 is a cross sectional view showing the apparatus of FIG. 2 in use.

FIG. 3 shows a preferable embodiment of the apparatus in use. Bolts 13 (offset from bolts 11) are passed through holes 10 in the lower element AA to anchor it in place on the casting bed. It can be seen that the shaping surfaces 5 provide a chamfer on the edges of the component 14. If necessary, reinforcing material 15 can be included in the precast element according to methods known in the art. In particular, reinforcing may be included by forming holes in the sheet 4 of a mould and passing such reinforcing as required through to project into the mould. Optionally the reinforcing may project through corresponding holes in the sheets on opposite sides of the mould to pass through the entire width or length of the mould. Such reinforcing may be placed under tension to form pre-stressed concrete as known in the art. Inserts (not shown), such as nuts, may be included in a component by attachment to the inner face of a sheet 4 using plastic nail plates or other methods as known in the art.

It will be appreciated that functionally equivalent methods of anchoring the elements to the casting bed and attaching the elements to each other are anticipated by the invention. For example, the nut 12B could be tack-welded in place or alternatively could be replaced by a washer and bolt arrangement, or a bolt 11 with a suitably sized head.

Figure 4:
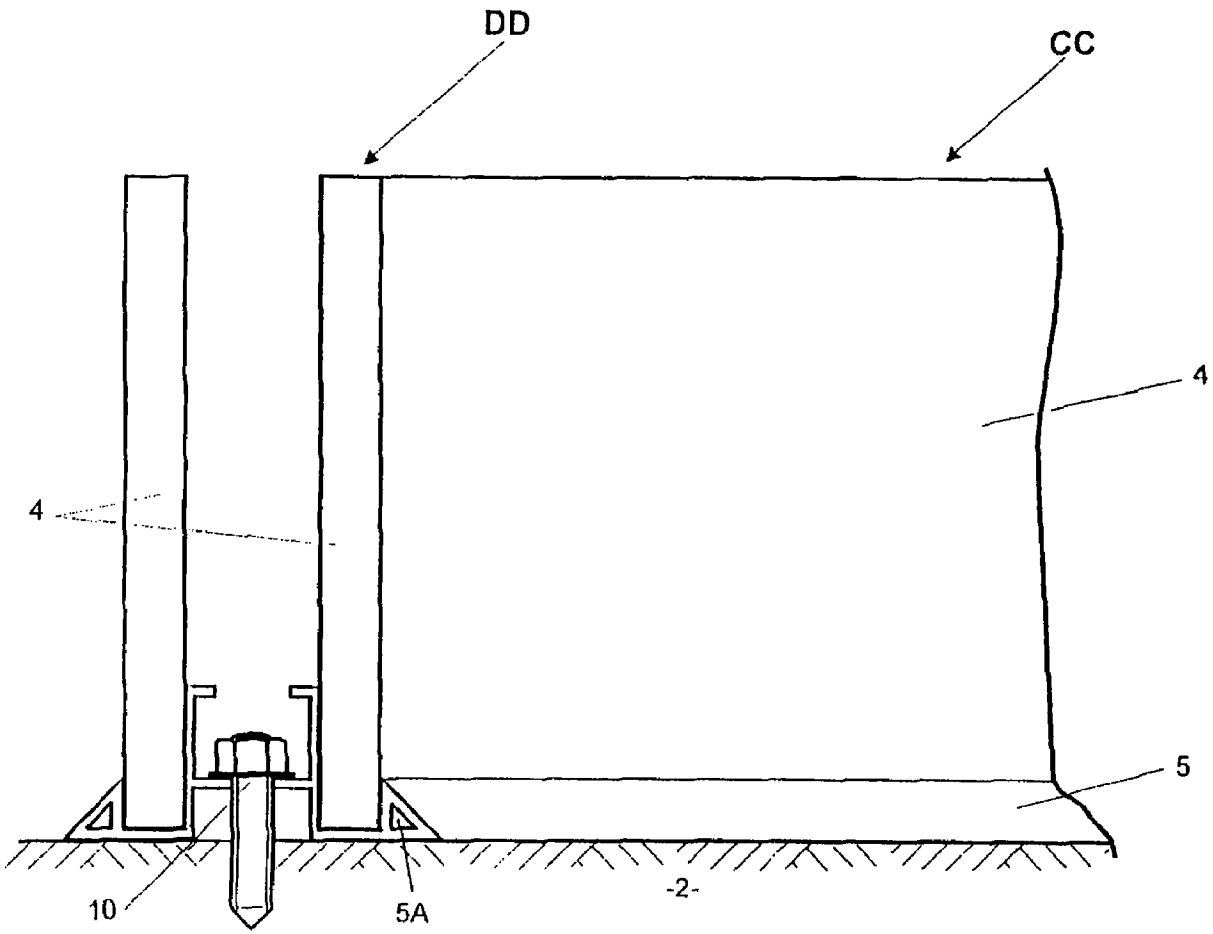
FIG. 4 is a cross-sectional view showing how a corner of a mould is formed.

As shown in FIG. 4, to create comers in a mould, a first element CC may be abutted to a second element DD by cutting the longitudinal end of the first element CC (and the sheets it carries) to accept the projection 5A of the second element DD as shown in FIG. 4.

Figure 5:
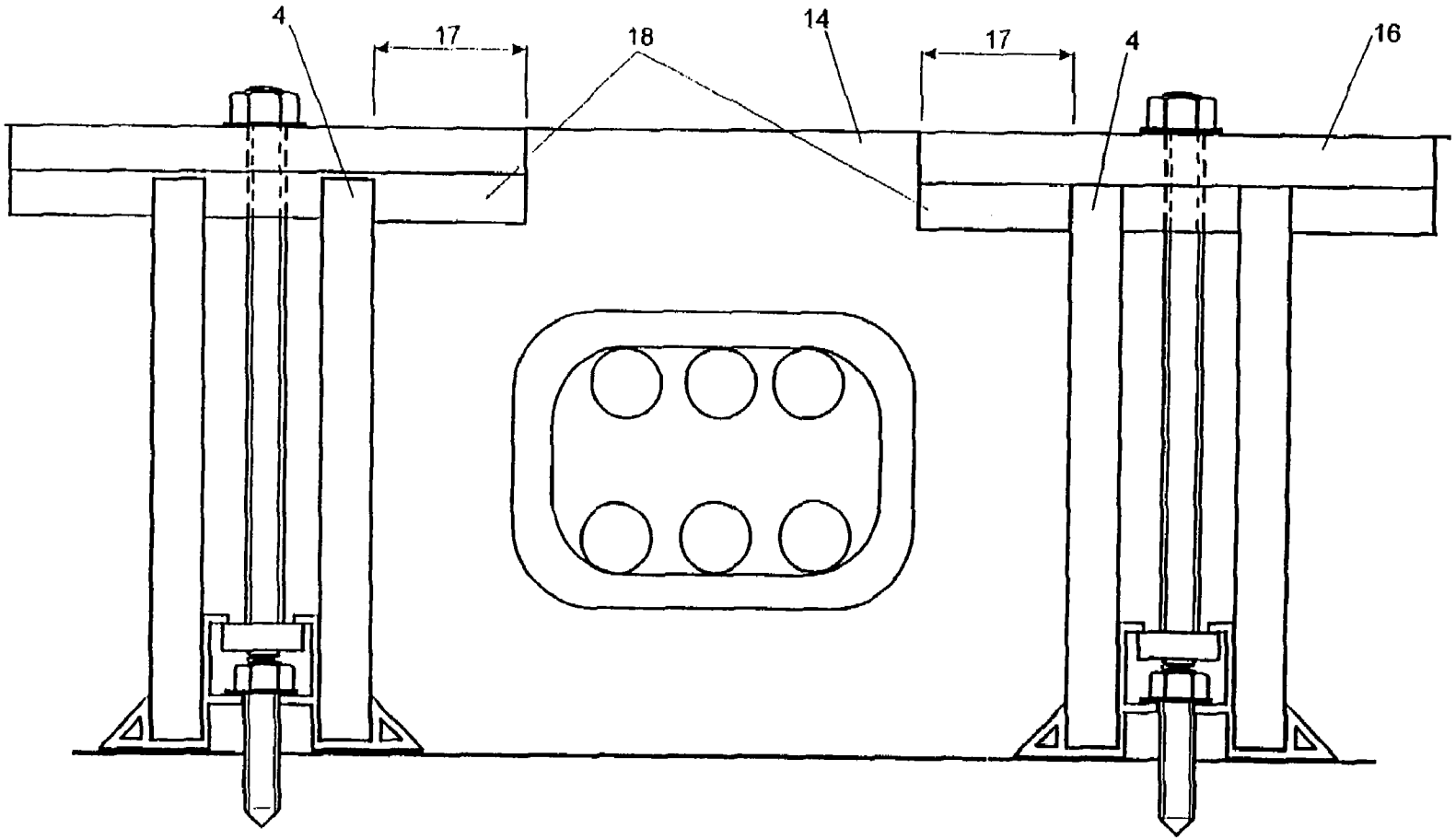
FIG. 5 is a cross-sectional view showing another embodiment of the apparatus.

A further embodiment of the invention is shown in FIG. 5 where the component to be precast requires rebating. Rebating is known in the art and is necessary where components are required to interlock or fit together in particular ways. In place of a second element, a rebater 16 abuts the upper ends of the sheets 4 and is bolted into place as shown. The rebater 16 overlaps the sheet 4 as necessary to create a rebate of the desired width 17. If a deeper rebate is required than that afforded by the rebater, spacers 18 can be affixed, preferably using screws, to the underside of the rebater as shown. If a rebate of varying or intermittent width 17 is required, this is also possible using the apparatus of the invention. This method affords simple mould preparation and ensures rebates are produced accurately. Preferably the rebater is made from wood or plywood.

As can be seen from FIGS. 2, 3 and 5, the assembled apparatus is symmetrical. This allows components to be cast directly side by side so, for example, two castings require three sides of boxing not four as the centre boxing becomes common. This serves to preserve and maximise space on a casting bed.

In a typical set of elements and sheets for precasting concrete components, preferably the elements are of a uniform length longer than the longest sheet. This aims to ensure that joins between sheets do not correspond to joins between elements, except where a corner is required as explained above and shown in FIG. 4. The sheets 4 may be practically any size or shape.

In a preferred embodiment the element is extruded from aluminium or plastic. Alternatively, the elements may be formed using glass fibres and reinforced with resin (fibreglass). The sheets are preferably made of plywood. Other suitable materials include timber, steel, plastics.

Figures 6, 7:
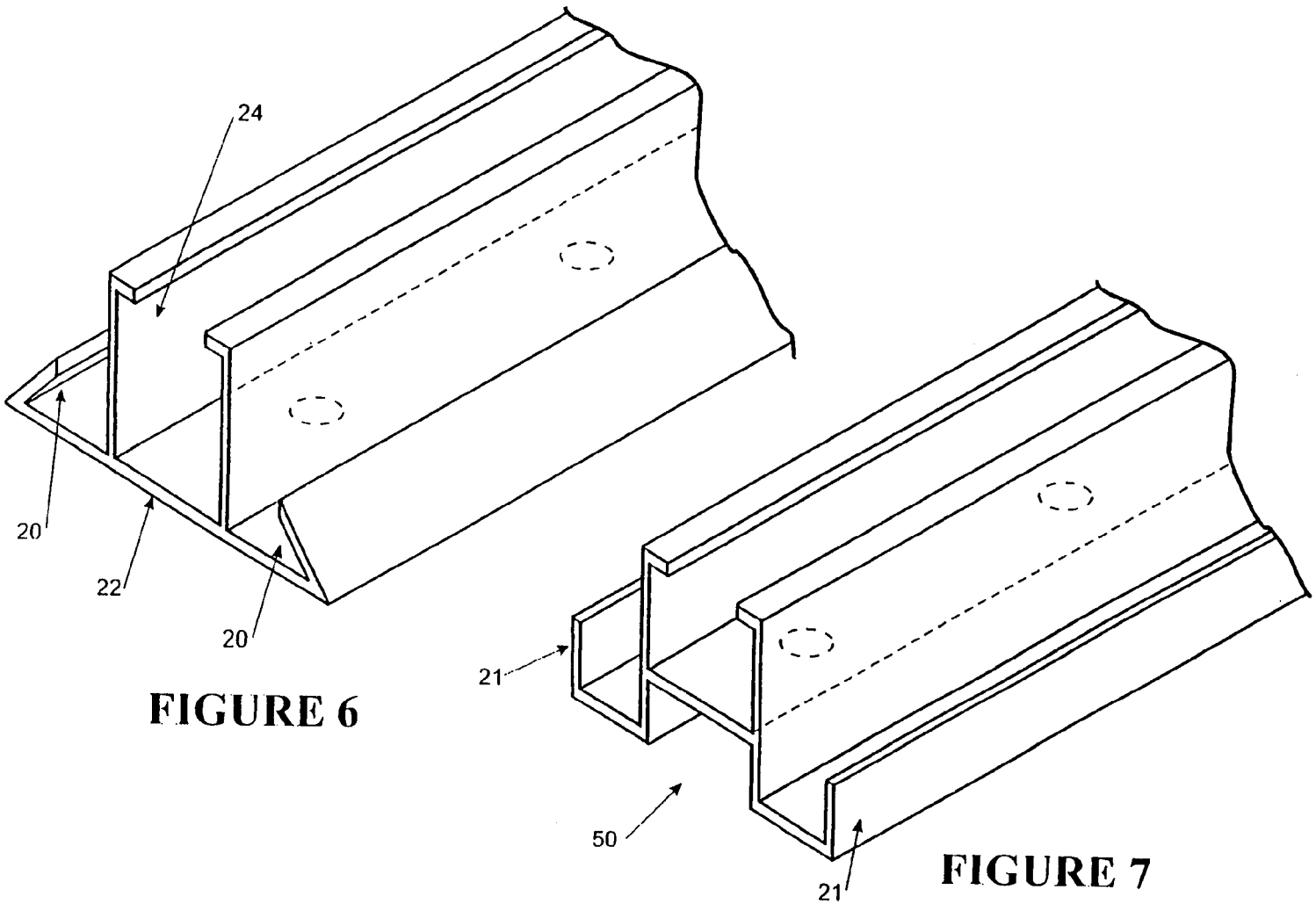
FIG. 6 is a perspective view of an alternative embodiment of the casting element.
FIG. 7 is a perspective view of yet another embodiment of the casting element.

FIG. 6 illustrates an alternative form of a casting element. Compared to the embodiment illustrated in FIG. 1, the bridge 6*a* is lowered to align with the base to thereby form a level base 22 as shown. This defines a channel 24 running the length of the element. Furthermore, instead of the projections 5*a* being formed with three sides, only two sides of the projection are formed including a first part as an extension of the base and a second part which is a shaping surface which defines the chamfer on the element to be cast. Nevertheless, the projections still define two channels 20 running the length of the casting element to receive the sheets 4 to define the walls.

FIG. 7 illustrates yet another embodiment of the casting element 50. It will be seen that this embodiment of the casting element 50 does not include the projections to the form the chamfers. Instead, the outer edges of the casting element 50 have upturned lips 21 to define two U-shaped channels to receive the edges of the sheets 4.

It will be appreciated that the casting elements of the invention may define a curve alone their longitudinal length.

Figure 8:
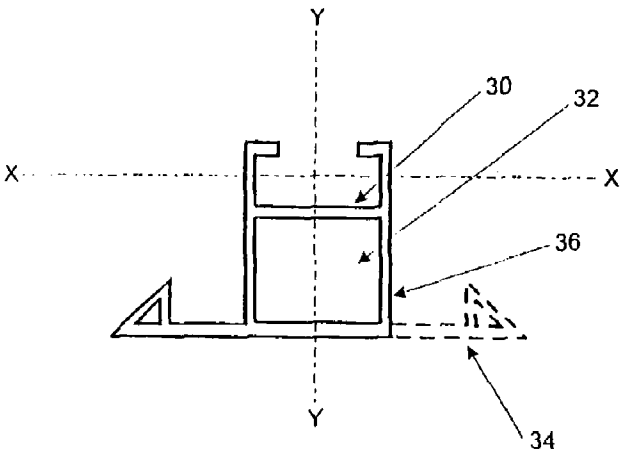
FIG. 8 is a cross-sectional view of another embodiment of the casting element.

FIG. 8 illustrates a cross-section of a casting element designed to be curved along its length. The particular form of the casting element includes a bridge 30 with the base being continuous across the bottom of the element as shown to define a cavity 32. Additionally, one of the chamfering portions 34 may be removed as illustrated by the part in phantom. The section may be rolled around the Y-Y axis to a desired radius. The centre of the radius may originate from either side of the element. The section may be rolled into a curve. a circle or into a serpentine shape.

Alternatively, the section may be rolled around the X-X axis with the centre of the radius originating from either above or below the section. This may have particular application when casting vertically oriented components as will be explained further in connection with FIG. 9.

Figure 9:
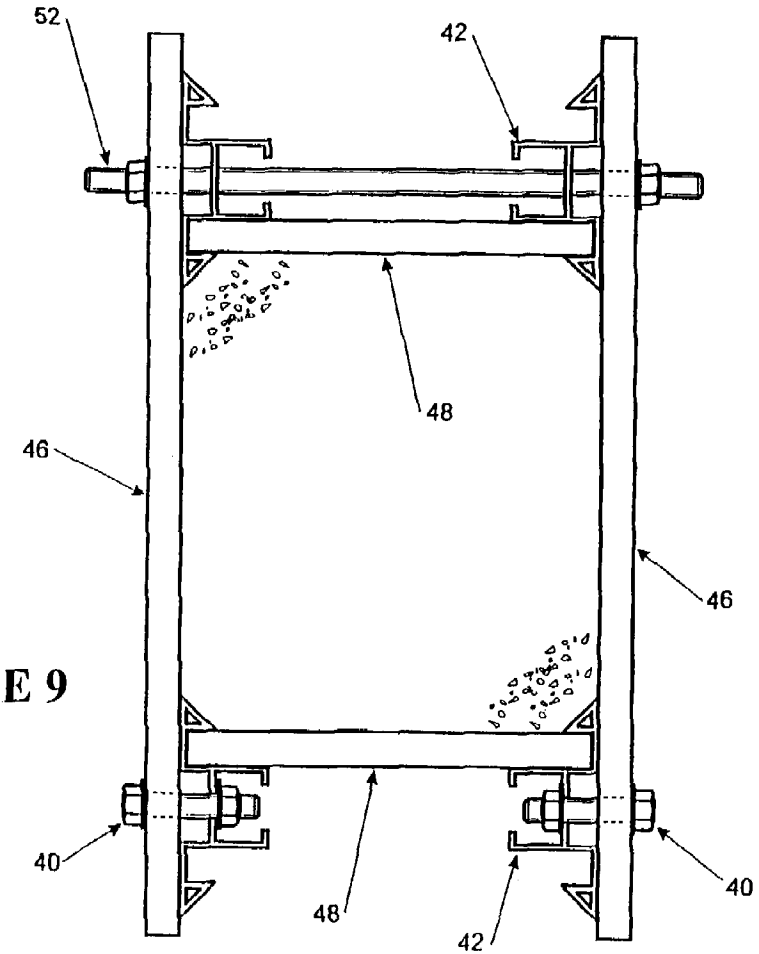
FIG. 9 is a cross-sectional view of a further embodiment of an assembled apparatus according to the present invention.

FIG. 9 illustrates an alternative apparatus used to form vertical column in situ. Whilst the figure illustrates a manner of forming a column, the same approach can also be applied to forming a wall or any other kind of vertically oriented component.

Two casting elements 42 are anchored to a substrate 46 in spaced disposition. The substrate 46 may be a form as used in convention form work. The two casting elements 42 and the substrate 46 may then be vertically oriented. Similarly, two further casting elements 42 may be affixed to a second substrate 46 and oriented to face the first mentioned assembly. The two remaining sides of the column can then be defined by two sheets 48 each received in the innermost U-shaped channels of opposed casting elements.

The entire assembly is mounted on a base defined by a series of casting elements 50 (of FIG. 7. These casting elements 50 may be secured to the construction site with each of the sheets 48 inserted into one of the U-shaped channels of one of the casting elements 50. Furthermore, the upright forms 46 may be likewise received in channels of one of the casting elements 50. When the assembly is in place, the column formwork can be strengthened using the threaded bolt 52 to clamp the two forms 46 together.

An additional benefit of the apparatus of the present invention is that components can be easily cast with one stacked above the other.

Figure 10A:
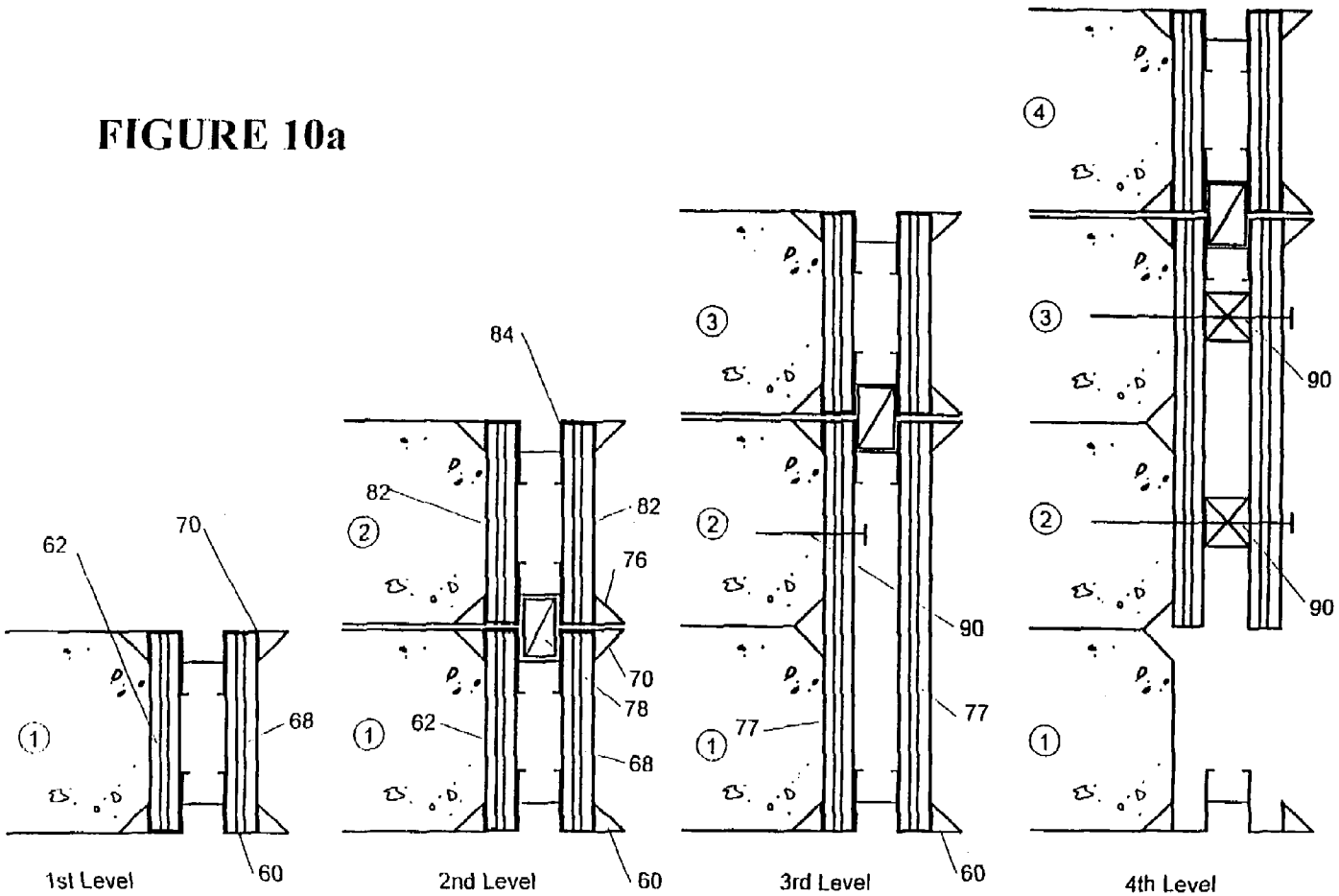
FIG. 10*a* illustrates a method of stack casting according to a preferred embodiment of the present invention.
Figure 10B:
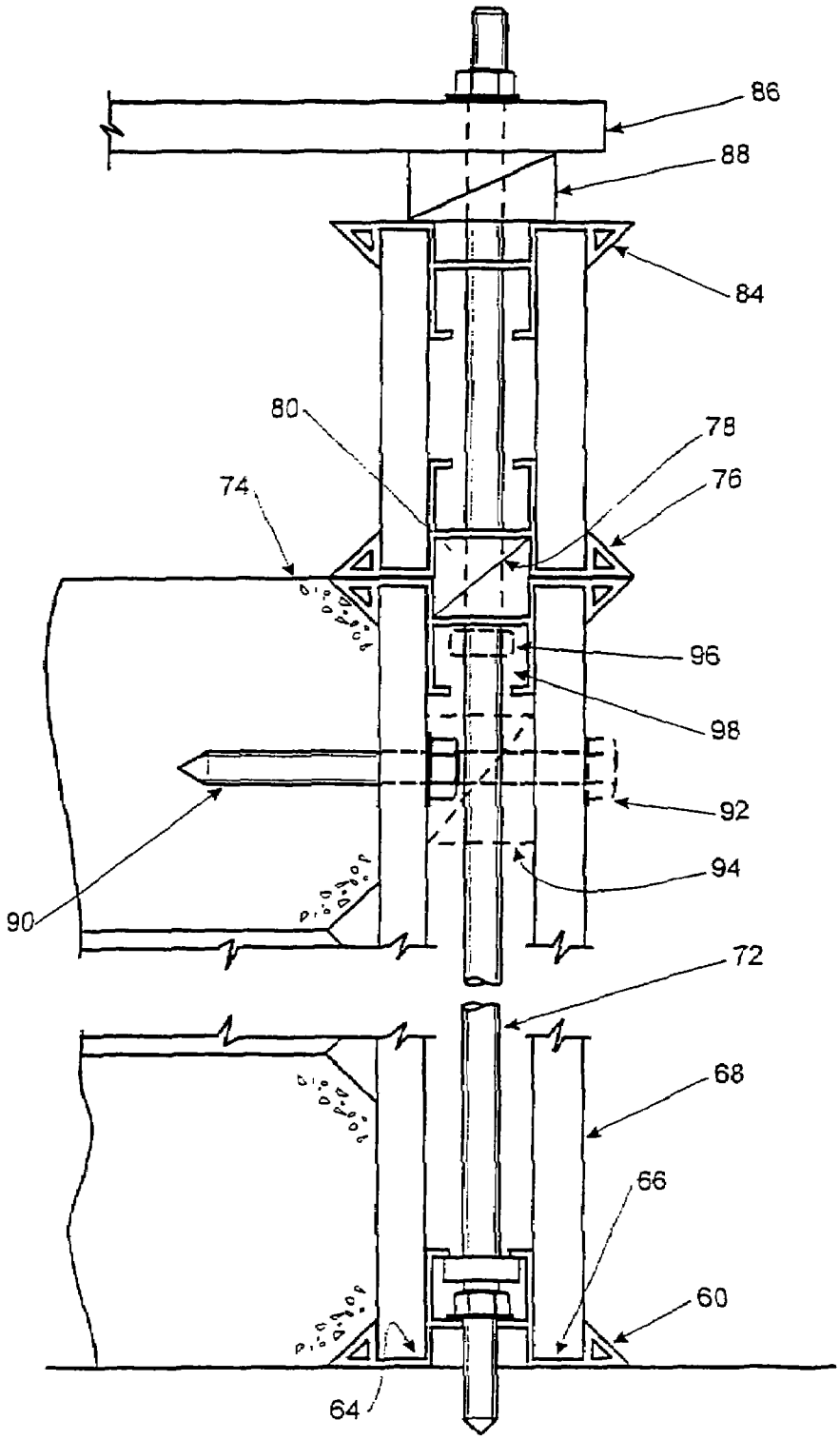
FIG. 10*b* illustrates components of FIG. 10*a* in greater detail.

FIG. 10*a* illustrates schematically how this can be done whereas FIG. 10*b* illustrates the components of FIG. 10*a* in greater detail. In use, one would fix the first ring of casting elements 60 to the casting bed in the desired shape of the concrete component to be cast. The sheets 62 are then placed in the innermost U-channel 64 to create a dam for the concrete. The other U-shaped channels may also be fitted with sheets 68 if required. The upper casting element 70 is then positioned over the tops of the sheets 62, 68 and secured with a threaded rod in the manner explained in connection with FIG. 2. The concrete can the be poured into the first level and allowed to harden.

To make a second layer of concrete another casting element 76 is placed on top of the casting element 70. More specifically, a blocking piece 78 is first inserted into the cavity 80 formed between the two casting elements 70, 76. Sheets 82 may be then added to the desired height and capped with another casting element 84. The assembly may be then strengthened by a tie 86 in the manner illustrated in FIG. 10*b*. The tie 86 extends over the whole assembly to another casting element on the other side. This process of simply stacking the casting elements with intervening sheets one atop the other may be continued until the desired number of concrete components has been cast.

However in a more preferred form of the invention, one need not continuously stack the casting elements and intervening sheets one atop the other. As indicated in the third level in FIG. 10*a*, the casting elements 70 and 76 may be removed with the walls 62, 68 and 82 substituted instead for two taller wall portions 77 as illustrated. The inner sheet 77 is secured to the second level of the hardened concrete component by means of anchoring member 90. The removed casting elements 70, 76 can then be used to cast the third level as shown. It is worthwhile to note that any of the sheets 62, 68, 77 which are disposed underneath the current level of the component being cast need not be continuous around all sides of the assembly.

In order to cast the fourth level onwards, the sheets 77 may be disengaged from the lowest casting element 60 and moved so that their tops are level with the uppermost layer of the hardened concrete and secured in that position by anchoring member 90. The anchoring member 90 extends through both sheets 77 and through blocking 94 disposed between the two sheets. Additionally, the threaded rod 72 may be secured as illustrated in FIG. 10*b* by use of a nut 96 in the C-shaped cavity 98 level with the top of the hardened concrete 74. The stacking may then continue with further casting elements being placed on the top to construct the fourth level. This procedure may be completed for fourth and subsequent levels.

Figure 11:
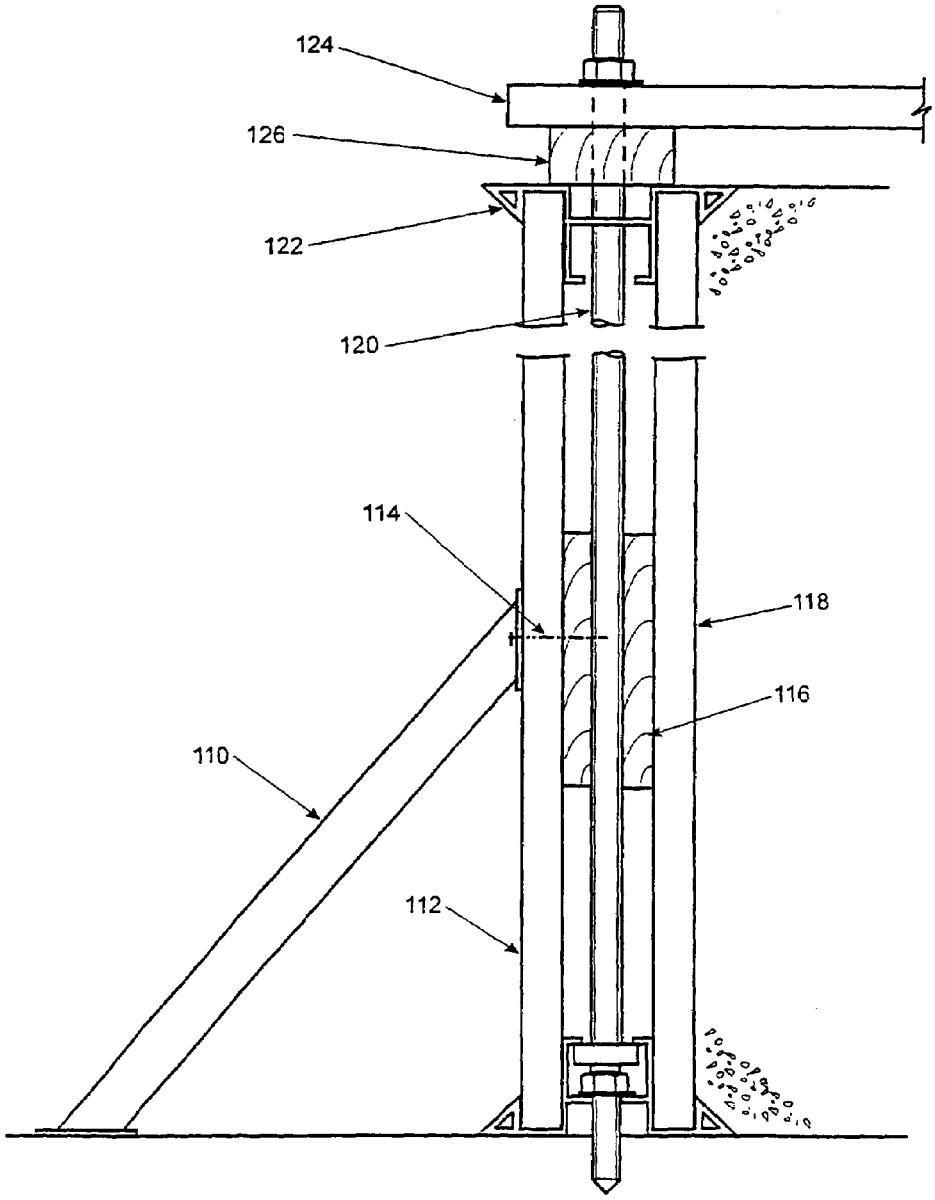
FIG. 11 illustrates a further embodiment of the assembled apparatus of the invention.

FIG. 11 illustrates an assembly for relatively tall concrete components to be cast. A plurality of braces 110 are fixed to the casting bed and to the side of the sheet 112. The anchoring members 114 may be secured through the sheet 112 into blocking 116 provided between the two sheets 112, 118. The entire assembly may be strengthened through the use of a threaded rod 120. Additionally, a tie 124 may be placed to extend from one side of the assembly to another. A blocking piece 126 may be placed between the tie 124 and the top casting element 122 to give space for future work or other ties.

The above describes some preferred embodiments of the present invention and indicates several possible modifications but it will be appreciated by those skilled in the art that other modifications can be made without departing from the scope of the invention as defined in the following claims.

The invention claimed is:

1. Formwork for casting a concrete component, said formwork comprising:

a plurality of wall portions suitable as sides for casting a component, a plurality of elongate elements, each including a mounting portion and a locating portion, the mounting portions in use being adjacent an exterior face of the wall portions, the locating portions of the plurality of elongate elements being adapted to receive at least an edge of one or more of the wall portions, additional elongate members having a locating portion adapted to receive an opposite edge of said wall portions, and a further mounting portion in use being adjacent an exterior face of the wall portions, and a plurality of clamping devices to connect said elongate elements and the additional elongate members.

2. Formwork as claimed in claim 1, wherein said mounting portion is an upwardly open channel having inwardly turned flanges, and said additional mounting portion is an upwardly open channel, and wherein said clamping devices include a bolt or threaded rod and said upwardly open channel is adapted to receive a bolt head or a nut in use and the open channel having inwardly turned flanges to receive a bolt head or nut.

3. Formwork as claimed in claim 1, wherein each of said elongate elements has at least first and second locating portions, each of which are adapted to in use to receive a wall portion, said first and second locating portions arranged on either side of a centrally disposed mounting portion.

4. Formwork as claimed in claim 1, wherein said elongate elements are anchored to the casting substrate through the mounting portion.

5. Formwork as claimed in claim 1, wherein the mounting of the elongate elements to said casting substrate is offset longitudinally from said clamping portion of said elongate elements to said additional elongate members.

6. Formwork as claimed in claim 1, wherein said elongate elements have a chamfering portion adapted to truncate the apex of the mould space defined by said casting substrate and said wall portions, and wherein the chamfering portion is a separate element affixed to said casting substrate.

7. Formwork as claimed in claim 1, wherein said additional elongate members are identical to said elongate elements, said additional elongate members are reversed in orientation in use.

8. Formwork as claimed in claim 1, wherein the longitudinal end of an elongate element is cut away to accept the intersecting chamfering portion of an intersecting elongate element.

9. Formwork as claimed in claim 1, wherein said formwork is adapted to allow additional formwork to sit rigidly on lower formwork and allow concrete components to be cast one atop the other.

10. Formwork for casting a concrete component, comprising:

a casting substrate, an elongate casting element which includes a mounting portion and a locating portion, the locating portion bearing against the casting substrate, a wall portion having a width commensurate with the width of the sides of the component to be cast, and one edge located in said locating portion of the elongate casting element, an additional elongate casting member located on an opposing edge of the wall portion, the additional elongate casting member having a further locating portion engaged over the opposing edge of the wall portion, with the additional elongate casting member also including a mounting portion, the mounting portions of the elongate casting element and additional elongate casting member are each disposed to a same side of the wall portion, and a clamping device connecting said elongate casting element and the additional elongate casting member.

11. Formwork as claimed in claim 10, wherein said mounting portion is an upwardly open channel having inwardly turned flanges, and said additional mounting portion is an upwardly open channel.

12. Formwork as claimed in claim 10, wherein the additional mounting portion is an upwardly open channel with inwardly pointed ledges on both legs.

13. Formwork as claimed in claim 10, wherein said clamping device comprise a bolt or threaded rod and said upwardly open channel is adapted to receive a bolt head or a nut and the open channel having inwardly turned flanges to receive a bolt head or nut.

14. Formwork as claimed in claim 10, wherein said elongate casting element has at least a first and second locating portions, each of which are engaged over an edge of a wall portion, said mounting portion is centrally disposed between said locating portion and an additional locating portion.

15. Formwork as claimed in claim 10, wherein said elongate casting element is anchored to the casting substrate through the mounting portion.

16. Formwork as claimed in claim 10, wherein the mounting of the elongate casting element to said casting substrate is offset longitudinally from said clamping portion of said elongate casting element to said additional casting element.

17. Formwork as claimed in claim 10, wherein said elongate casting element has a chamfering portion adapted to truncate the apex of the mould space defined by said casting substrate and said wall portions, and wherein said chamfering portion is a separate element affixed to said casting substrate.

18. Formwork as claimed in claim 10, wherein said additional elongate casting member is identical to said elongate casting element but reversed in orientation.

19. Formwork as claimed in claim 10, wherein a longitudinal end of the elongate casting element is cut away to accept the chamfering portion of an intersecting elongate casting element.

20. Formwork as claimed in claim 10, wherein said formwork is adapted to allow an additional elongate casting element to sit rigidly on a lower formwork and allow concrete components to be cast one atop the other.

21. Formwork for casting a vertical concrete column or wall, comprising:

a chamfering portion adapted to chamfer an edge of the vertical column or wall;

a locating portion adapted to receive a projecting member which is discrete from said chamfering portion and locate said projecting member adjacent to said chamfering portion, to define one side of the column or wall; and a mounting portion to receive an intersecting additional projecting member which is discrete from the chamfering portion and the mounting portion, to define a second side of the vertical column or wall, the projecting members together defining a first corner of the vertical column or wall.

22. Formwork as claimed in claim 21, further comprising an additional locating portion adapted to receive the opposing edge of the projecting member;

a chamfering portion adapted to chamfer a second corner of the said column or wall, and a mounting portion to receive an intersecting additional third projecting member which is discrete from the chamfering and mounting portions, to define a third side of the vertical column or wall, the projecting members together defining a second corner of the vertical column or wall.

23. Formwork as claimed in claim 21, further comprising an additional locating portion adapted to receive the opposing edge of the fourth projecting member to define a fourth side, a chamfering portion adapted to chamfer a third corner of the said column or wall, and a mounting portion to receive the intersecting third projecting member which is discrete from the chamfering and mounting portions, to define a third corner of the vertical column or wall.

24. Formwork as claimed in claim 21, further comprising an additional locating portion adapted to receive the opposing edge of the fourth projecting member to define a fourth side;

a chamfering portion adapted to chamfer a fourth corner of the said column or wall, and a mounting portion to receive the intersecting additional projecting member which is discrete from the chamfering and mounting portions, to define a fourth corner of the vertical column or wall.

25. Formwork as claimed in claim 21, wherein a plurality of elongate vertical members are placed against the projecting members.

26. Formwork as claimed in claim 21, wherein a first and a third projecting member and a second and a fourth projecting member are clamped with a plurality of clamps which are discrete from the locating and chamfering and locating portions to hold the projecting members against movement.

27. Formwork as claimed in claim 21, wherein the elongate vertical members on a first and a third projecting members and the elongate vertical members on a second and a fourth projecting members are clamped with a plurality of clamps which are discrete from the locating and chamfering and locating portions to hold the projecting members against movement.

28. Formwork for casting a vertical concrete column or wall, comprising:

a first upright form, commensurate with a width of the vertical column or wall, which defines a first side of the column or wall, a first elongate casting element which includes a mounting portion and a locating portion, the mounting portion anchoring said casting element against the first upright form so that the locating portion bears against the first upright form, a wall portion having a width commensurate with a width of the column or panel to be cast which defines a second side of said column or wall, and one edge located in said locating portion of the first elongate casting element, a second upright form, commensurate with the width of the column or wall which defines a third side of the column or wall, a second elongate casting member located on an opposing edge of the wall portion, the second elongate casting member having a further locating portion engaged over the opposing edge of the wall portion, and the second elongate casting member also including a mounting portion, the mounting portion of the first and second casting elements being each disposed to the same side of the wall portion, and clamping devices connecting the first and second elongate casting elements.

29. Formwork as claimed in claim 28, further comprising:

a third elongate casting element which includes a mounting portion and a locating portion, the mounting portion anchoring said third elongate casting element against the first upright form, that defines the first side, so that the locating portion bears against the first upright form, a second wall portion having a width commensurate with a width of the column or wall to be cast, and one edge located in said locating portion of the third elongate casting element, a fourth elongate casting member located on the opposing edge of the second wall portion, the fourth elongate casting member having a further locating portion engaged over the opposing edge of the second wall portion, and the fourth elongate casting member also including a mounting portion, the mounting portion of the third and fourth casting elements are each disposed to the same side of the second wall portion, and clamping devices connecting the third and fourth elongate casting elements.

* * * * *